United States Patent [19]

Hoshino

[11] 4,368,606

[45] Jan. 18, 1983

[54] SOCKET MEANS FOR EMBEDMENT IN A CONCRETE SLAB

[75] Inventor: Zenji Hoshino, Tokyo, Japan

[73] Assignee: Sanyo Industries, Ltd., Japan

[21] Appl. No.: 169,081

[22] Filed: Jul. 15, 1980

[30] Foreign Application Priority Data

| | | | |
|---|---|---|---|
| Jul. 31, 1979 | [JP] | Japan | 54-106039[U] |
| Sep. 17, 1979 | [JP] | Japan | 54-128155[U] |
| Sep. 28, 1979 | [JP] | Japan | 54-134388[U] |
| Dec. 13, 1979 | [JP] | Japan | 54-172881[U] |

[51] Int. Cl.[3] ..... E04B 1/41

[52] U.S. Cl. ..... 52/711; 52/709

[58] Field of Search ..... 52/701, 704, 707, 709, 52/711

[56] References Cited

U.S. PATENT DOCUMENTS

| | | | |
|---|---|---|---|
| 1,351,112 | 8/1920 | Martin | 52/711 |
| 1,710,422 | 4/1929 | Kehm | 52/711 |
| 2,020,062 | 11/1935 | Jackson | 52/711 X |
| 2,156,639 | 5/1939 | Powell | 52/709 |
| 3,290,851 | 12/1966 | Sherburne | 52/701 |
| 3,514,911 | 6/1970 | Preradovich | 52/704 X |

FOREIGN PATENT DOCUMENTS

| | | | |
|---|---|---|---|
| 68218 | 7/1951 | Netherlands | 52/709 |
| 139751 | 11/1920 | United Kingdom | 52/711 |
| 842334 | 7/1960 | United Kingdom | 52/709 |

*Primary Examiner*—J. Karl Bell

*Attorney, Agent, or Firm*—Robert E. Burns; Emmanuel J. Lobato; Bruce L. Adams

[57] ABSTRACT

A socket having a socket body which is accurate in position when in use. The body is provided with an internal blind bore having an open end and a closed end. The blind bore defines or has a portion defined by inner surfaces which converge in a direction toward the open end of the blind bore and diverge toward the closed end. This bore portion is spaced axially from the open end. Within this portion of the bore is disposed a locking element made of at least two segments that have an axial extent less than the length of the above-mentioned portion. The segments have outer side surfaces which are complementary with the converging inner surfaces of the portion of the blind bore. They are each provided with a thread and jointly define a bore of lesser diameter than the open end and accordingly of lesser diameter than an anchor bolt insertable axially into the socket body. When an anchor bolt having threads complementary to the threads of the segments the leading end of the bolt engages the segments and moves them axially within the socket body. As the segments move axially, they move outwardly radially and allow the bolt to fully enter between the segments and develop threading engagement. As the anchor bolt is moved axially outwardly, the segments move along the converging surfaces and clamp the bolt in position. The bolt can be removed by rotating it to unthread it.

2 Claims, 11 Drawing Figures

SOCKET MEANS FOR EMBEDMENT IN A CONCRETE SLAB

BACKGROUND OF THE INVENTION

1. Field of the Invention

This invention relates to a socket for embedding in a cementitious structure such as a concrete ceiling, floor, deck or the like.

2. Statement of the Prior Art

Numerous types of bolt anchors or sockets have been heretofore proposed for embedment in concrete. Representative prior patents in the field are U.S. Pat. No. 3,982,363 to J. P. Dorris, U.S. Pat. No. 4,055,929 to N. F. Stancati et al., and U.S. Pat. No. 4,083,162 to J. F. Regan.

SUMMARY OF THE INVENTION

The present invention relates to an improved socket to be embedded in concrete during the casting thereof in a mold panel, the socket is adapted to receive an anchor bolt for the secure fastening of objects such as cradlings, cabling racks, utility walls or the like to the concrete.

More specifically, the invention provides a socket having a locking element for threaded engagement with an anchor bolt, said element having a plurality of internally threaded subdivided sections which allow the bolt to intrude by quick linear thrusting into the socket. The arrangement being such that the rate of speed of attachment of the bolts to the anchors can be increased manifold as compared to conventional designs which have required the bolt to move rotatively into threaded engagement with the socket which is necessarily only progressive, hence tedious and time-consuming.

The invention will be better understood by referring to the following description taken in conjunction with the accompanying drawing which illustrates by way of example certain preferred embodiments which the invention may assume in practice.

DESCRIPTION OF THE PREFERRED EMBODIMENTS

Figure 2:
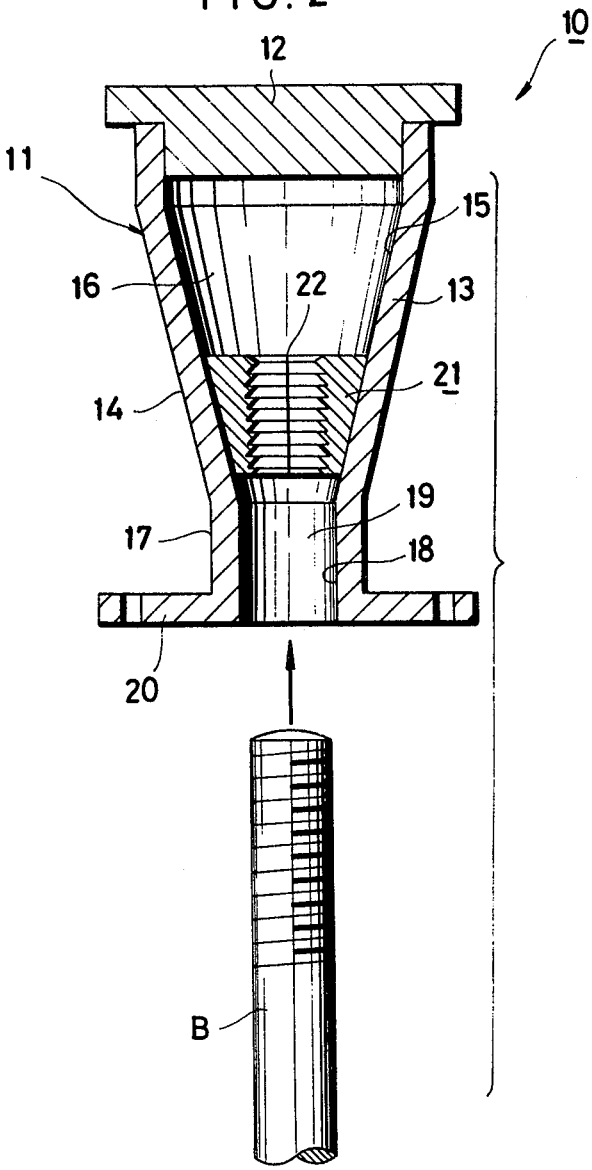
FIG. 2 is a longitudinal cross-sectional view of the socket prior to receiving an anchor bolt.

Referring now to the drawing and FIG. 2 in particular, there is shown a socket generally identified by reference numeral 10. The socket means 10 comprises a socket body 11 which is tapered or reduced in diameter progressively toward its bottom end. The top end of the socket body 11 is closed by a top end wall 12, while the bottom end is open for purposes to be hereinafter described. The socket body 11 has a peripheral longitudinal side wall 13 having a downwardly tapered portion 14 whose interior peripheral wall 15 defines a chamber 16 generally in the form of an inverted truncated cone and a relatively short perpendicular tubular portion 17 whose interior wall 18 defines a constricted bore 19 of constant diameter, this diameter being slightly larger than the diameter of a companion anchor bolt B. The bore 19 communicates with the chamber 16 above and is open at the lower end of the socket. The side wall 13 terminates at a lower outward peripheral flange 20.

Figure 5:
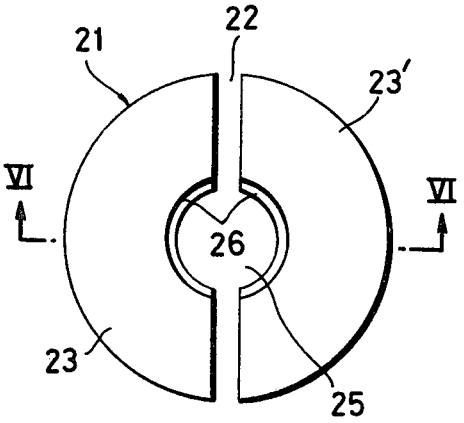
FIG. 5 is a top plan view of a locking element constituting part of the socket.
Figure 6:
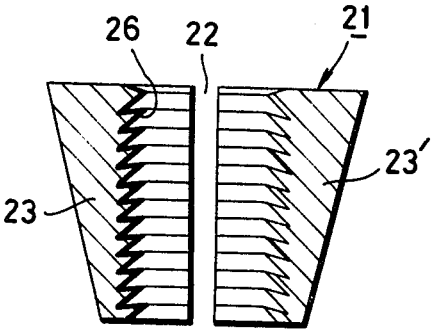
FIG. 6 is a sectional view on the line VI—VI of FIG. 5, looking in the direction of the arrows.
Figure 7:
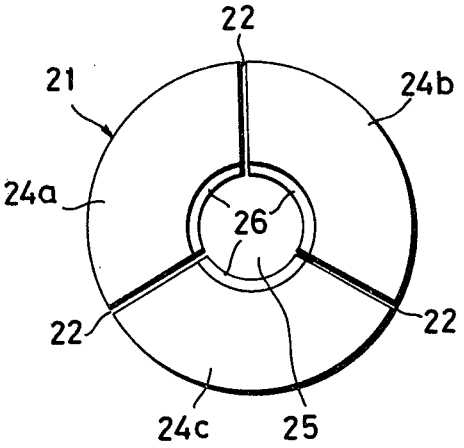
FIG. 7 is a top plan view of a modified form of locking element according to the invention.
Figure 9:
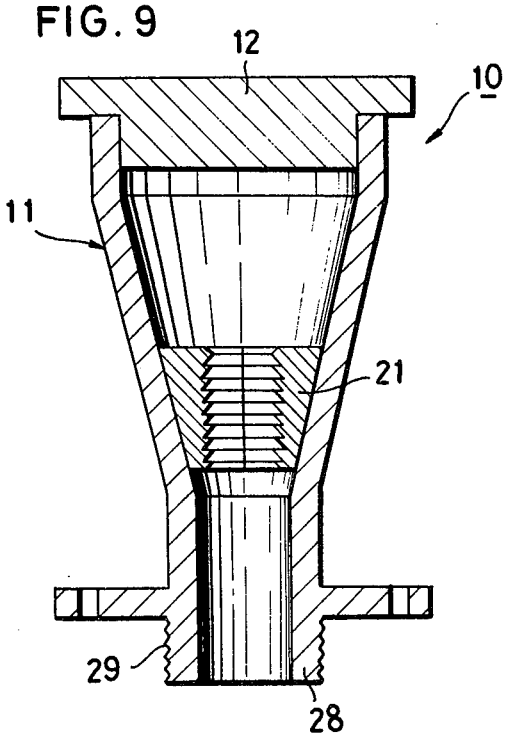
Figure 10:
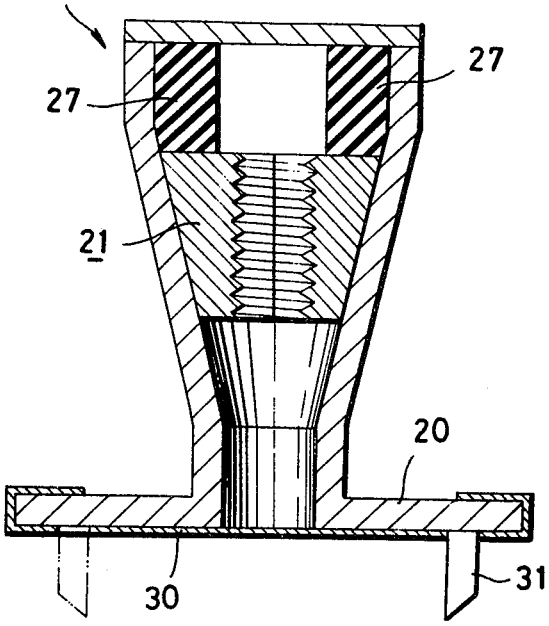
Figure 11:
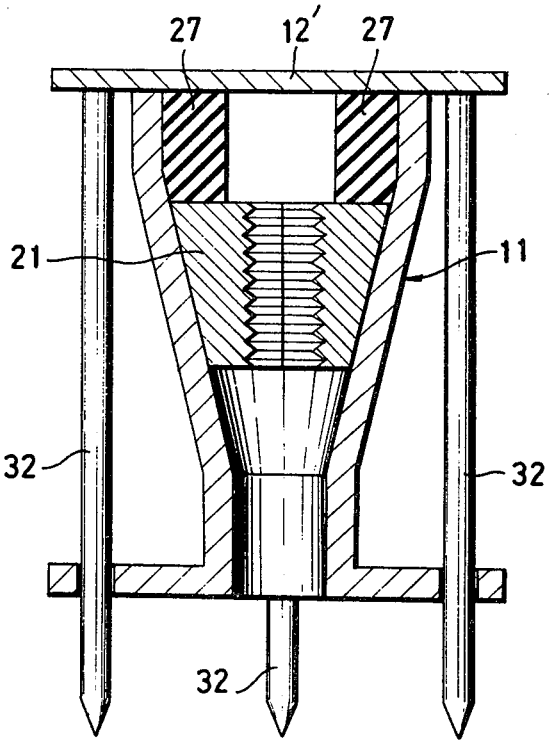

The socket 10 according to the invention includes a locking element 21 generally in the shape of a truncated cone which is subdivided longitudinally by slits 22 into identical halves 23,23', as shown in FIG. 5 or into three equal segments 24*a*, 24*b* and 24*c* as shown in FIG. 7. The locking element 21 is externally complimentary in shape with and movably mounted concentrically in the truncated-cone chamber 16. In its assembled position (FIG. 5 and FIG. 7), the locking element 21 is provided centrally therein with a through bore 25 which is circular in cross section and defined by internal threaded walls 26 and concentric with the constricted bore 19 in the socket body 11. The threads of the element 21 may be straight and parallel as better shown in FIG. 2 or FIG. 6, or may be spiral as in ordinary female screws as shown in FIGS. 9 to 11.

The locking element 21 is constituted by a plurality of subdivided parts such that they are movable relative to each other within the chamber 16 of the socket body 11. Stated otherwise, the locking element 21 is expandable telescopically radially across its center circular bore 25 simultaneously as it ascends within the chamber 16 longitudinally along the interior peripheral wall 15.

Figure 3:
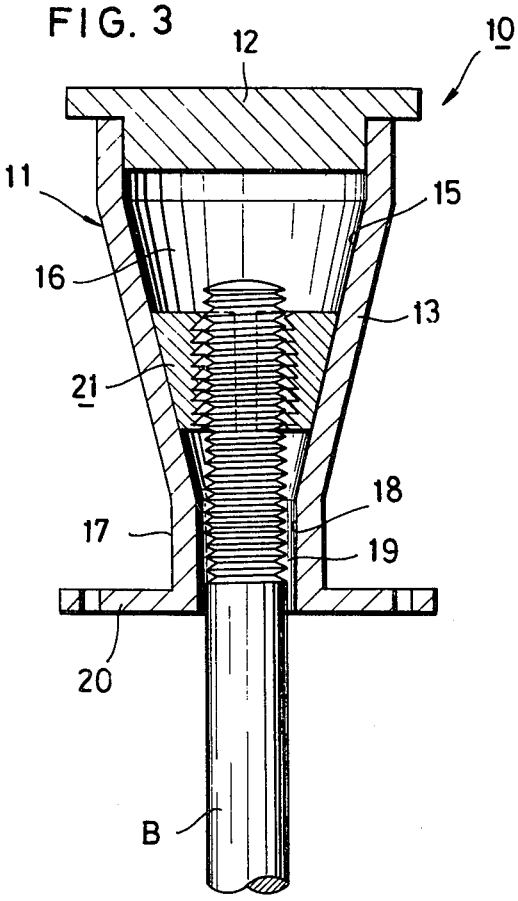
FIG. 3 is a view of the socket similar to FIG. 2 but showing the same in temporary engagement with the bolt.
Figure 4:
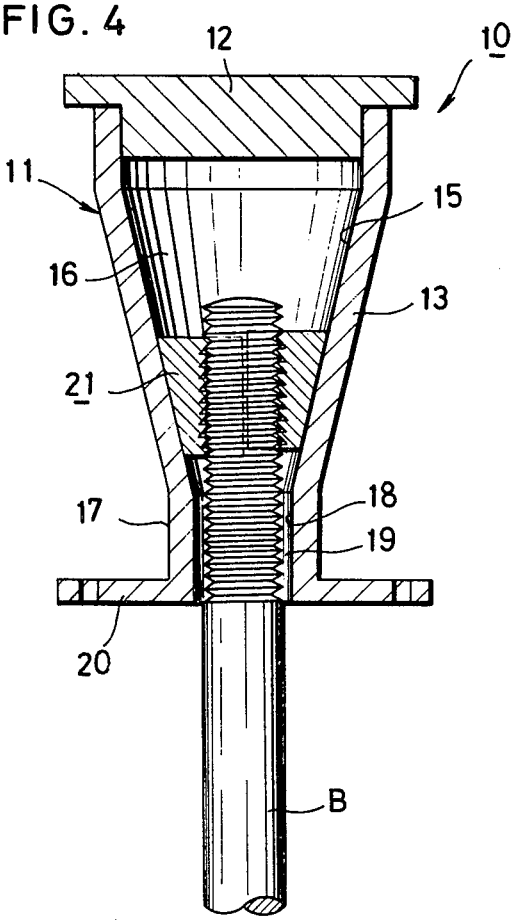
FIG. 4 is a view similar to FIG. 3, but showing the socket in complete engagement with the bolt.

The operation of the socket means 10 will now be described with particular reference to FIGS. 2 to 4. The socket means 10 is shown in FIG. 2 to be in its rest or inoperative condition in which the locking element 21 is at the lowermost position with subdivided halves 23,23' or segments 24*a*, 24*b* and 24*c* united together, forming substantially continuous bore 25. The companion anchor bolt B is fitted through the constricted bore 19 into the threaded bore 25, which is usually done after the sockets are mounted in place in concrete C in a manner to be hereafter described. The insertion of the bolt B through the threaded bore 25 is facilitated by radially expansive movement of the locking element 21 which takes place in response to the force applied by the bolt B tending to move the element 21 upwardly in sliding contact with the interior peripheral wall 15 until the element reaches its uppermost position, as illustrated in FIG. 3. Because of this structural and functional arrangement, bolt insertion can be effected quickly by a thrusting action, instead of slow progressive threading as is necessitated by conventional male and female screws. From the uppermost position of the locking element 21 (FIG. 3) in which the bolt B is temporarily engaged with the element 21, the bolt B is pulled as far down as is permitted by radially contractive movement of the element 21 to a locked position shown in FIG. 4. In this position, the bolt B is completely in threaded engagement with the locking element 21, prohibiting expansion or upward movement of the locking element 21 as illustrated in FIG. 4. In this instance, the subdivisions (23,23' or 24*a* to 24*c*) of the element 21 are slightly shifted out of alignment with each other due to the behaviour of a parallel formation of threads of the element 21 which resembles in effect a spiral formation of threads. The final or locked position of the socket 10 represents an effect analogous to that attained by threading a bolt progressively into a thread by thread engagement with a nut, but such effect is obtainable far much faster according to the invention.

If desired, the bolt B can be removed simply by rotating the same in a direction or usually counterclockwise to disengage from the locking element 21.

Figure 8:
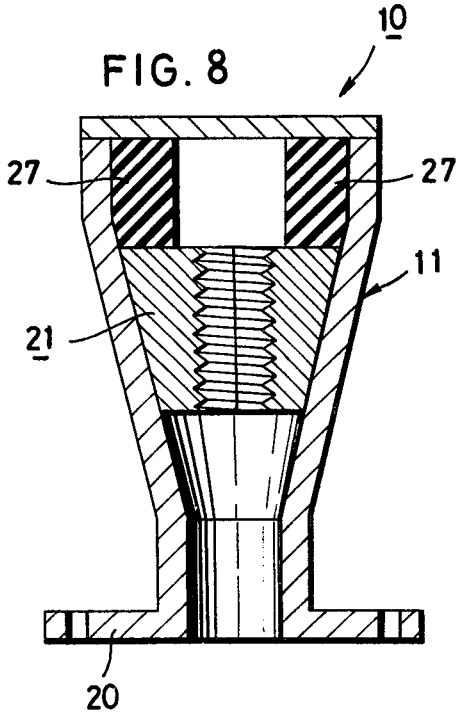
FIGS. 8 through 11 inclusive show, in a view similar to FIG. 3, various modifications of the socket according to the invention.

FIG. 8 illustrates a modification of the socket 10 which is characterized by the provision of a resilient member 27 engageable with the locking element 21. The resilient member 27 is secured at its upper end to the inner surface of the top wall 12 with its lower end free to permit the member 27 to expand and contract in contact with the locking member 21.

Figure 1:
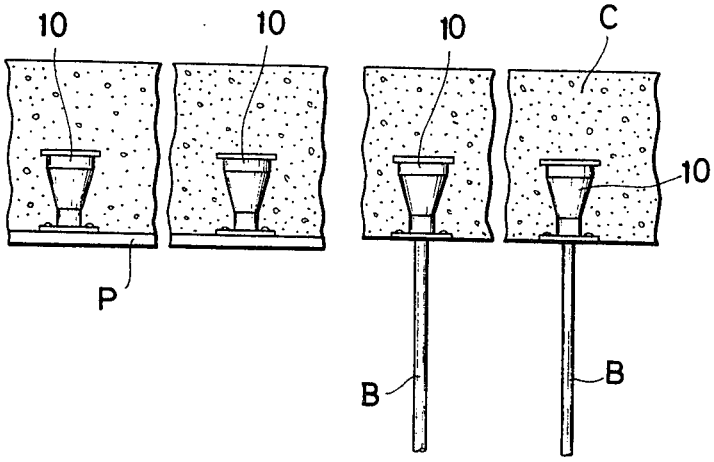
FIG. 1 diagrammatically illustrates a concrete slab in which a plurality of sockets according to the invention are mounted.

FIGS. 9 through 11 inclusive illustrate various modifications associated with the socket means 10 of the invention which are directed to a means of affixing the socket means 10 to a mold panel P shown in FIG. 1.

The modification shown in FIG. 9 provides an extension 28 of the constricted bore 19 which is externally threaded at 29 for engagement in a threaded hole (not shown) in the mold panel P.

The modification in FIG. 10 provides an enlarged flange 20' to which a bracket member 29 is attached, the member 30 having nails or similar means 31 for securing the socket means 10 to the panel P.

The modification in FIG. 11 provides an enlarged top wall 12' which carries a plurality of elongated nails 32 adapted to secure the socket means 10 to the panel P.

Having thus described the invention, it will be understood that various further modifications or changes may be made in the form and construction herein advanced, without departing from the scope of the appended claims.

What is claimed is:

1. A socket comprising, a socket body to be anchored in fixed position when in use and having an internal blind bore having an open end and a closed end, said blind bore having a portion axially spaced from the open end of the blind bore, said portion having inner surfaces converging in a direction toward the open end of the blind bore and diverging toward the closed end of the blind bore, an internally threaded locking element in said portion of the blind bore, for releasably securing an externally threaded bolt in said blind bore portion upon insertion of the bolt axially into the blind bore and without need of rotating the bolt to thread it with the locking element, said locking element comprising at least two, separate segments having outer side surfaces complementary with the converging inner surfaces of said portion of the blind bore, said segments each having an axial extent less than the axial length of said portion of the blind bore and each having an internal thread, said segments being dimensioned to slide axially on the inner surfaces diverging toward the closed end of the bore and disposed jointly defining an internal threaded bore concentric with the blind bore and of lesser diameter than the diameter of a threaded bolt with complementary threads insertable axially into said blind bore for threading with said locking element without rotation of the bolt, whereby when a bolt to be secured with said socket and having threads complementary with the threads of the segments is inserted into said socket body a leading end of the inserted bolt engages said segments and moves them axially along the diverging surfaces of the blind bore toward the closed end of the blind bore and separates them radially to effect threading with the locking element by simple axial insertion into said blind bore and upon movement of the bolt axially in a direction away from the closed end said segments are moved to the converging surfaces and clamp about the bolt threads and hold it fixed in said portion in a threaded condition.

2. A socket according to claim 1, including an anchor bolt releasably threaded with said locking element, and said bolt being removable by unthreading from the locking element by rotating in a direction for unthreading it.

* * * * *